US011146007B2

(12) United States Patent
Chen et al.

(10) Patent No.: US 11,146,007 B2
(45) Date of Patent: Oct. 12, 2021

(54) ELECTRICAL CONNECTOR AND METHOD FOR MANUFACTURING THE SAME

(71) Applicant: LOTES CO., LTD, Keelung (TW)

(72) Inventors: Chih Kun Chen, Keelung (TW); Wen Chang Chang, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 17/030,786

(22) Filed: Sep. 24, 2020

(65) Prior Publication Data

US 2021/0159627 A1 May 27, 2021

(30) Foreign Application Priority Data

Nov. 25, 2019 (CN) ..... 201911165181.2
Dec. 5, 2019 (CN) ..... 201911235616.6

(51) Int. Cl.

| | |
|---|---|
| ***H01R 12/00*** | (2006.01) |
| ***H01R 13/24*** | (2006.01) |
| ***H01R 13/50*** | (2006.01) |
| ***H01R 43/00*** | (2006.01) |
| ***H01R 43/20*** | (2006.01) |

(52) U.S. Cl.

CPC ..... *H01R 13/2435* (2013.01); *H01R 13/50* (2013.01); *H01R 43/007* (2013.01); *H01R 43/20* (2013.01)

(58) Field of Classification Search

CPC ..... H01R 23/722; H01R 23/725; H01R 23/6658; H01R 23/7073; H01R 12/585; H01R 13/20; H01R 13/6315; H01K 3/368

USPC ..... 439/66, 74, 75, 76.1, 79, 82, 324, 248

See application file for complete search history.

(56) References Cited

U.S. PATENT DOCUMENTS

| | | | | |
|---|---|---|---|---|
| 4,927,369 | A | 5/1990 | Grabbe et al. | |
| 6,176,707 | B1 | 1/2001 | Neidich et al. | |
| 6,592,382 | B2 * | 7/2003 | Wurster ..... | H05K 3/366 439/82 |

(Continued)

FOREIGN PATENT DOCUMENTS

| | | | |
|---|---|---|---|
| CN | 1701471 | A | 11/2005 |
| CN | 2770130 | Y | 4/2006 |

(Continued)

*Primary Examiner* — Phuong Chi Thi Nguyen

(74) *Attorney, Agent, or Firm* — Locke Lord LLP; Tim Tingkang Xia, Esq.

(57) ABSTRACT

An electrical connector includes a body having an accommodating hole. The body has a protruding block and a platform protruding into the accommodating hole. The platform is located below the protruding block. A conductive terminal is accommodated in the accommodating hole. The conductive terminal has a base, which bends to form an accommodating space to accommodate the protruding block. The base has a through slot, and first and second branches located at two sides of the through slot. A lower section of the first branch is limited between the first protruding block and the platform. A method for manufacturing the electrical connector includes inserting the conductive terminal with the accommodating space opening upward into the accommodating hole by the strip, and rotating the conductive terminal with the protruding block as an axis, until the lower section of the first branch is located between the platform and the first protruding block.

20 Claims, 9 Drawing Sheets

A-A

(56) References Cited

U.S. PATENT DOCUMENTS

| | | | | |
|---|---|---|---|---|
| 6,824,396 | B2 | 11/2004 | Koopman et al. | |
| 7,963,796 | B2 * | 6/2011 | Sypolt | H01R 12/732 439/511 |
| 10,172,263 | B1 * | 1/2019 | Martin | H05K 1/115 |
| 10,276,955 | B2 * | 4/2019 | Lybrand | H01R 12/585 |
| 2003/0114027 | A1 * | 6/2003 | Wurster | H01R 12/737 439/82 |
| 2009/0269976 | A1 * | 10/2009 | Costello | H05K 1/142 439/510 |
| 2011/0104911 | A1 * | 5/2011 | Sypolt | H01R 12/58 439/65 |
| 2017/0365947 | A1 * | 12/2017 | Costello | H01R 13/2442 |
| 2021/0159627 | A1 * | 5/2021 | Chen | H01R 13/2435 |

FOREIGN PATENT DOCUMENTS

| | | | |
|---|---|---|---|
| CN | 200941464 | Y | 8/2007 |
| CN | 200972922 | Y | 11/2007 |
| CN | 201097405 | Y | 8/2008 |
| CN | 201838746 | U | 5/2011 |
| CN | 202434749 | U | 9/2012 |
| CN | 109687184 | A | 4/2019 |
| TW | M367467 | U | 10/2009 |

* cited by examiner

A-A

ELECTRICAL CONNECTOR AND METHOD FOR MANUFACTURING THE SAME

CROSS-REFERENCE TO RELATED PATENT APPLICATION

This non-provisional application claims priority to and the benefit of, pursuant to 35 U.S.C. § 119(a), patent application Serial No. CN201911165181.2 filed in China on Nov. 25, 2019, and patent application Serial No. CN201911235616.6 filed in China on Dec. 5, 2019. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and a method for manufacturing the same, and particularly to a double-sided compressed electrical connector and a method for manufacturing the same.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In a conventional double-sided compressed electrical connector, conductive terminals are formed by stamping a metal sheet. Generally, in the process of forming an entire conductive terminal by stamping, a fixing structure such as a barb is formed at an edge of the conductive terminal by stamping, to match with the walls of an accommodating hole accommodating the conductive terminal in a subsequent assembly process of the conductive terminal and the body of the electrical connector, such that the conductive terminal is fixed in the body. The fixing structure facilitates the mass production of the conductive terminals. However, this fixing structure tends to interfere with the body to retain the conductive terminal in the use of the electrical connector. For example, the barb is stuck into the walls of the accommodating hole, and a certain stress will be inevitably applied to the body by this fixing method. If the electrical connector is provided with a large quantity of conductive terminals, the stresses will be superimposed and amplified, causing the body to deform, and further affecting the use of the electrical connector, resulting in the case where a stable electrical connection between the electrical connector and mating components cannot be guaranteed.

Therefore, a heretofore unaddressed need to design an improved electrical connector exists in the art to address the aforementioned deficiencies and inadequacies.

SUMMARY

The present invention is directed to an electrical connector, in which a conductive terminal is limited between a protruding block and a platform, and a method for manufacturing the electrical connector.

To achieve the foregoing objective, the present invention adopts the following technical solutions.

An electrical connector is configured to be electrically connected with a first mating component and a second mating component. The electrical connector includes: a body, having an accommodating hole running vertically therethrough, wherein the body is provided with a first protruding block and a platform protruding into the accommodating hole, and the platform is located below the first protruding block; and a conductive terminal, accommodated in the accommodating hole, wherein the conductive terminal has a base which is bending, the base bends to form an accommodating space opening forward to accommodate the first protruding block, an upper elastic arm extends upward from one end of the base to be electrically connected with the first mating component, and a lower elastic arm extends downward from the other end of the base to be electrically connected with the second mating component, wherein the base has a through slot, and a first branch and a second branch located at a left side and a right side of the through slot, each of the first branch and the second branch has an upper section located above the accommodating space, a lower section located below the accommodating space, and a connecting section located behind the accommodating space, and the lower section of the first branch is limited between the first protruding block and the platform.

In certain embodiments, the connecting section is arc-shaped, and a rear edge of the first protruding block is arc-shaped to match with the connecting section and to limit the conductive terminal from moving forward.

In certain embodiments, the body is further provided with a second protruding block opposite to the first protruding block in a left-right direction in the accommodating hole, the second protruding block is accommodated in the accommodating space and is located above the platform, the lower section of the second branch is limited between the second protruding block and the platform, each of the first protruding block and the second protruding block has a guide chamfer, and the guide chamfers of both the first protruding block and the second protruding block are provided close to each other downward from top thereof.

In certain embodiments, in a left-right direction, a width of the lower section of the first branch is greater than a protruding length of the first protruding block.

In certain embodiments, the through slot extends forward along the base and passes beyond the first protruding block.

In certain embodiments, the platform extends forward and passes beyond the first protruding block.

In certain embodiments, the platform is connected to walls at a left side and a right side of the accommodating hole.

In certain embodiments, the platform has a channel correspondingly located below the first protruding block, and the channel runs downward through the body.

In certain embodiments, the connecting section is arc-shaped, and in a front-rear direction, an upper surface of the platform and walls of the accommodating hole are connected through an arc surface to match with the connecting section.

In certain embodiments, a lower edge of the first protruding block is arc-shaped to match with the connecting section in an assembly process of the conductive terminal.

In certain embodiments, the body further has a through hole running vertically therethrough, and in a left-right direction, the through hole is located at a side of the first protruding block away from the corresponding conductive terminal to increase elasticity of the body near the first protruding block.

In certain embodiments, in a front-rear direction, a length of the first protruding block is less than a length of the through hole.

In certain embodiments, the electrical connector includes a plurality of conductive terminals, wherein the body has a plurality of accommodating holes and a plurality of through holes, each of the accommodating holes correspondingly accommodates one of the conductive terminals, the accommodating holes and the through holes are respectively provided in a plurality of rows, the rows of the accommodating holes and the rows of the through holes are provided in the left-right direction at intervals, each row of the accommodating holes and each row of the through holes are respectively arranged in a front-rear direction, and two adjacent ones of the through holes located between two rows of the accommodating holes are corresponding to one accommodating hole in one of the two rows of the accommodating holes in the left-right direction.

In certain embodiments, a wall of the accommodating hole behind the base and an upper surface of the body are connected through a guide surface, and the guide surface is higher than the first protruding block.

Compared with the related art, certain embodiments of the present invention have the following beneficial effects. The lower section of the first branch is limited between the first protruding block and the platform, such that the conductive terminal is limited in the accommodating hole in a vertical direction. The connecting section of the first branch is limited between the first protruding block and the walls of the accommodating hole, such that the conductive terminal is limited in the accommodating hole in the front-rear direction. The conductive terminal does not interfere with the body much, and therefore the conductive terminal does not directly apply a relatively large stress to the body, and the body does not easily deform.

A method for manufacturing an electrical connector includes: S1: providing a body, wherein the body has an accommodating hole running vertically therethrough, the body is provided with a first protruding block and a platform protruding into the accommodating hole, the platform is located below the first protruding block; S2: providing a conductive terminal connected to a strip, the conductive terminal has a base which is bending, the base bends to form an accommodating space, an upper elastic arm extends upward from one end of the base, a lower elastic arm extends downward from the other end of the base, the base has a through slot, and a first branch and a second branch located at a left side and a right side of the through slot, and each of the first branch and the second branch has an upper section located above the accommodating space, a lower section located below the accommodating space, and a connecting section located behind the accommodating space; S3: inserting the conductive terminal with the accommodating space opening upward into the accommodating hole by the strip, such that the connecting section of the first branch passes across the first protruding block and to be located between the platform and the first protruding block; and S4: rotating the conductive terminal counterclockwise with the first protruding block as an axis, until the accommodating space is open forward, and the lower section of the first branch is located between the platform and the first protruding block.

In certain embodiments, in the step S4, the conductive terminal is rotated counterclockwise by 90 degrees.

In certain embodiments, in the step S1, the body is further provided with a second protruding block opposite to the first protruding block in a left-right direction in the accommodating hole, and the second protruding block is located above the platform; in the step S3, the connecting section of the first branch is abutted by the first protruding block when passing downward across the first protruding block, and the connecting section of the second branch is abutted by the second protruding block when passing downward across the second protruding block, such that the first branch and the second branch deform toward the through slot; and in the step S4, after the conductive terminal is rotated counterclockwise, the lower section of the second branch is limited between the second protruding block and the platform.

In certain embodiments, in the step S1, the strip is connected to a tail end of the upper elastic arm.

In certain embodiments, the strip is removed after the step S3 and before the step S4 is proceeded, and in the step S3, the conductive terminal is driven to rotate via a jig.

In certain embodiments, the connecting section is arc-shaped, a lower edge of the first protruding block is arc-shaped, and in a front-rear direction, an upper surface of the platform and walls of the accommodating hole are connected through an arc surface to match with the connecting section in the step S3.

Compared with the related art, certain embodiments of the present invention have the following beneficial effects. The conductive terminal is assembled into the body by maintain the accommodating space opening upward, such that the first protruding block interacts with a middle position of the first branch with substantially relatively good elasticity, thus reducing the force generated when the conductive terminal interferes with the body in the assembly process, and facilitating assembly. In addition, after the conductive terminal is assembled, the conductive terminal is limited in the accommodating hole by the first protruding block and the platform. The conductive terminal does not interfere with the body much, and therefore the conductive terminal does not directly apply a relatively large stress to the body, and the body does not easily deform.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
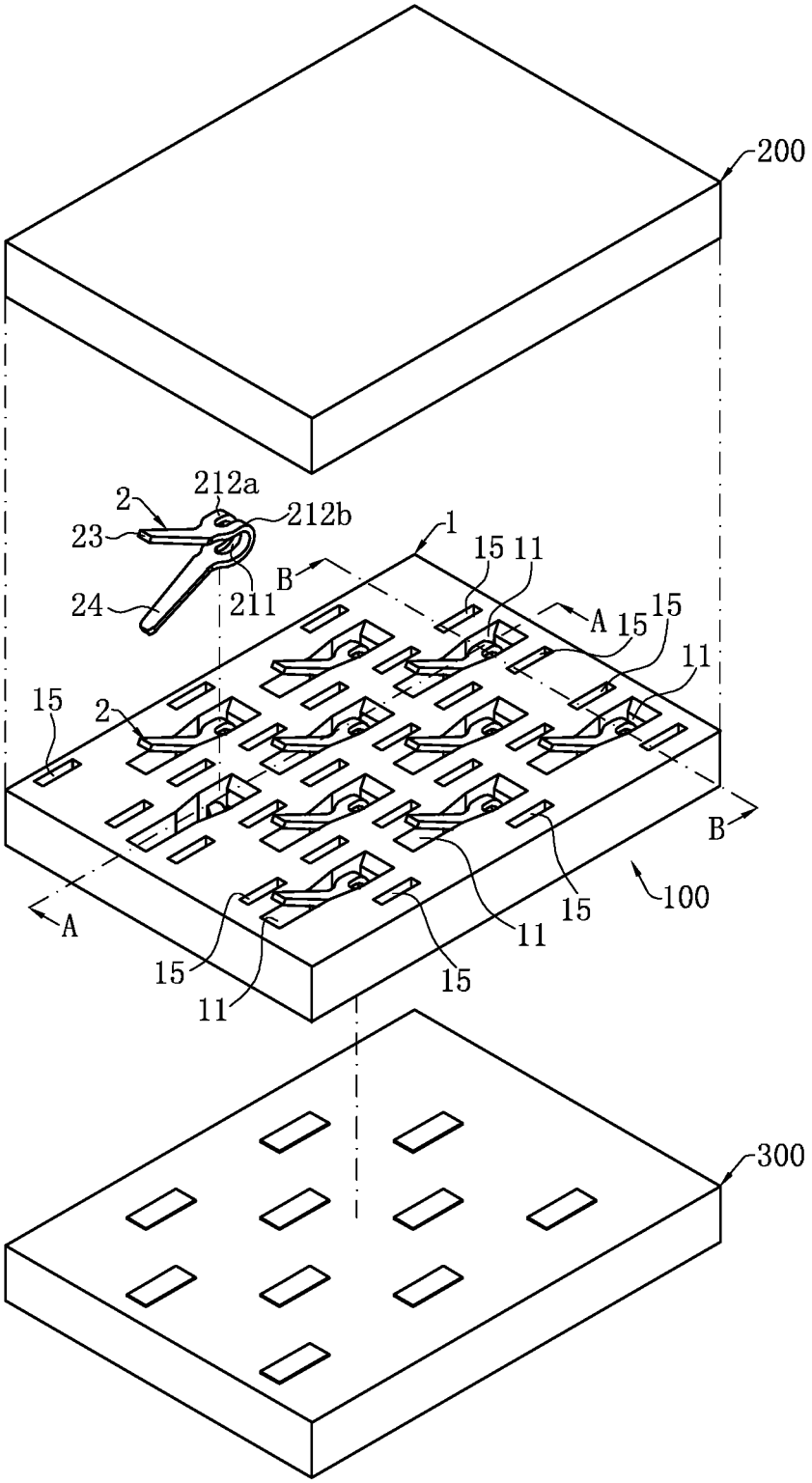
FIG. 1 is a schematic view of an electrical connector according to a first embodiment of the present invention, and a first mating component and a second mating component matching with the electrical connector.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to an electrical connector FIG. 1 shows an electrical connector 100 according to a first embodiment of the present invention, which is used to be electrically connected with a first mating component 200 and a second mating component 300. The electrical connector 100 includes a body 1 and multiple conductive terminals 2 accommodated in the body 1.

Figure 2:
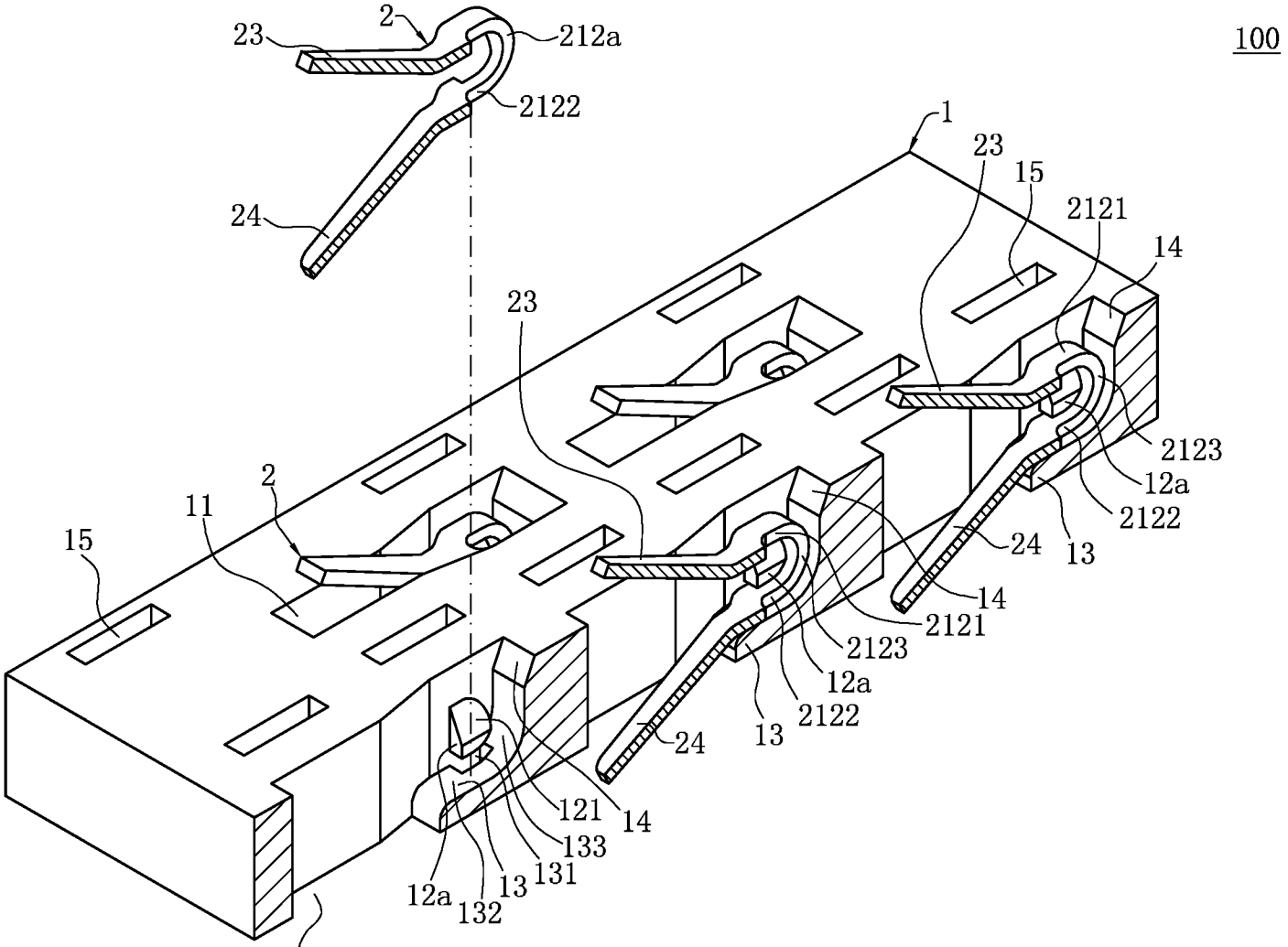
FIG. 2 is a perspective sectional view of the electrical connector in FIG. 1.
Figure 6:
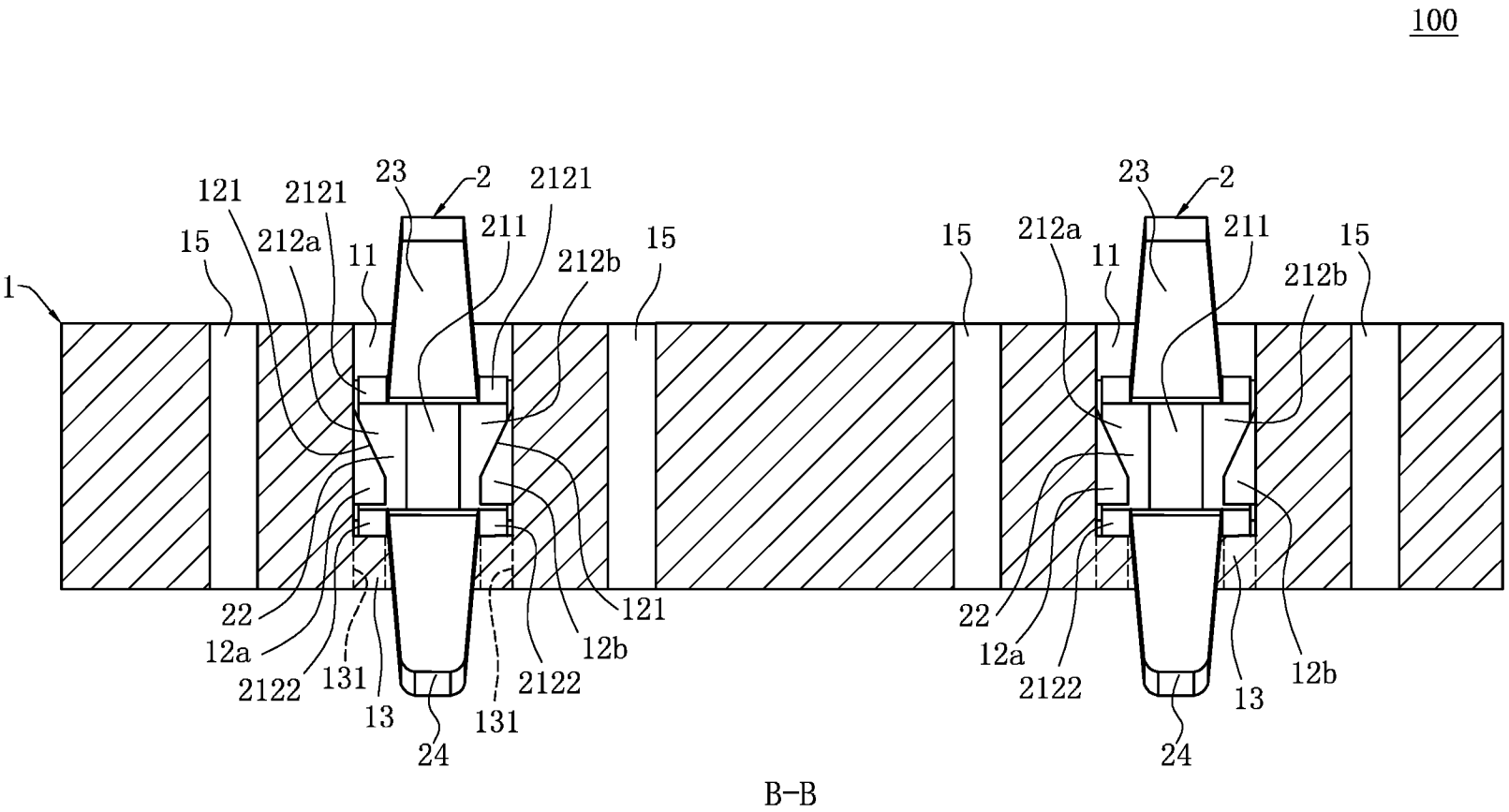
FIG. 6 is a sectional view of the electrical connector in FIG. 1 along a line B-B.

As shown in FIG. 1, FIG. 2 and FIG. 6, the body 1 is made of an insulating material and has multiple accommodating holes 11 running vertically therethrough to correspondingly accommodate the conductive terminals 2. The body 1 is provided with a first protruding block 12*a* protruding into each of the accommodating holes 11 respectively, a second protruding block 12*b* provided symmetrically with the first protruding block 12*a* in the left-right direction, and a platform 13 located below the first protruding block 12*a* and the second protruding block 12*b*. The first protruding block 12*a* and the second protruding block 12*b* correspondingly protrude from walls of each accommodating hole 11 at its left and right sides. Each of the first protruding block 12*a* and the second protruding block 12*b* has a guide chamfer 121. The guide chamfers 121 of both the first protruding block 12*a* and the second protruding block 12*b* are provided to be close to each other downward from top thereof. Rear edges of the first protruding block 12*a* and the second protruding block 12*b* are arc-shaped. The platform 13 protrudes forward from a wall of each accommodating hole 11 behind the first protruding block 12*a* and extends forward to pass beyond the first protruding block 12*a* and the second protruding block 12*b* to support the conductive terminal 2.

Figure 5:
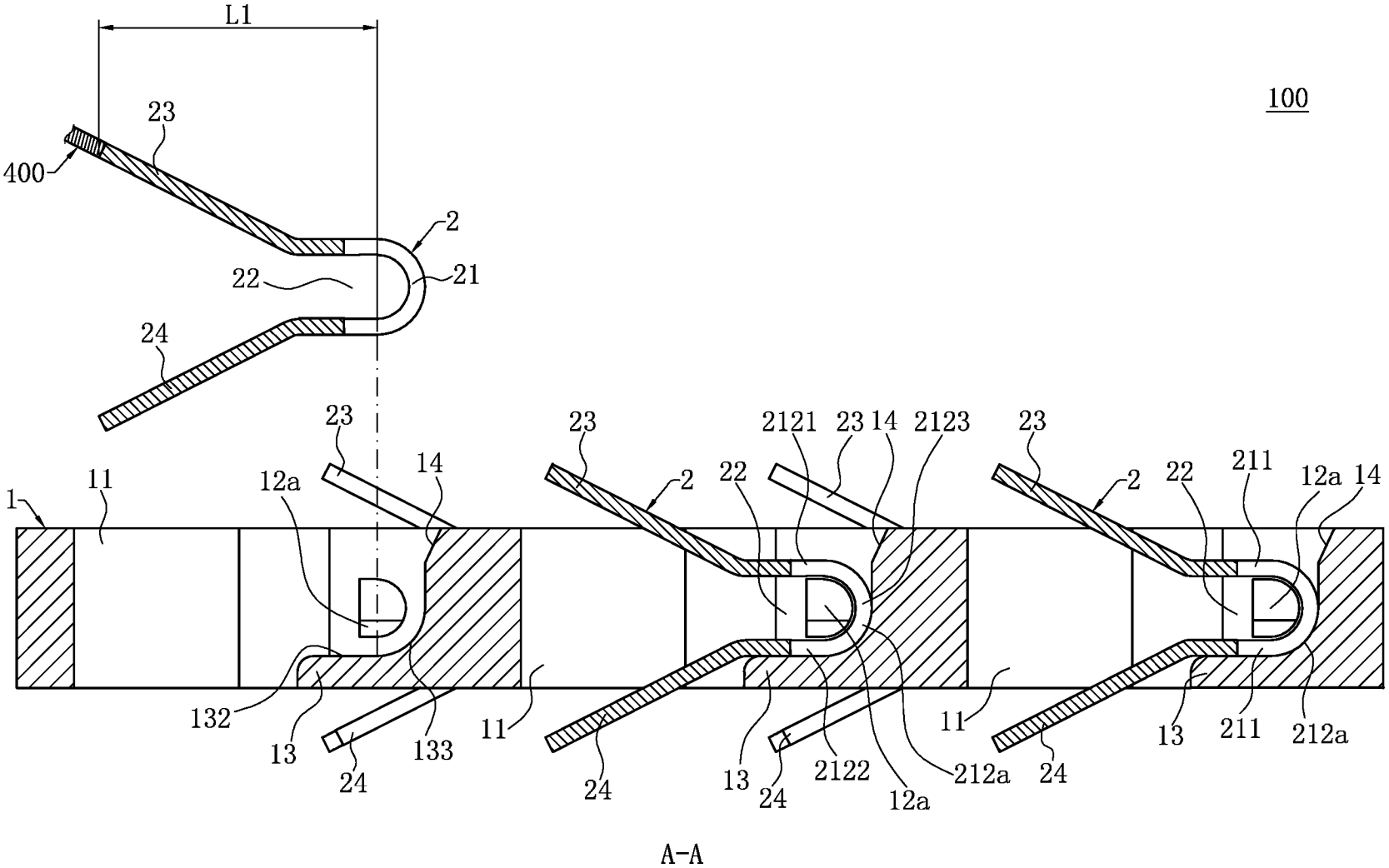
FIG. 5 is a sectional view of the electrical connector in FIG. 1 along a line A-A.

As shown in FIG. 2, FIG. 5, and FIG. 6, the platform 13 is connected to the walls at the left and right sides of each accommodating hole 11 simultaneously so as to enhance the strength of the platform 13. The platform 13 further has two channels 131 correspondingly located below the first protruding block 12*a* and the second protruding block 12*b*. The channels 131 run downward through the body 1 to allow a mold to pass therethrough during injection molding of the first protruding block 12*a* and the second protruding block 12*b*. In a front-rear direction, an upper surface 132 of the platform 13 and the walls of each accommodating hole 11 are connected through an arc surface 133.

As shown in FIG. 2 and FIG. 5, a wall of each accommodating hole 11 behind the base 21 and an upper surface of the body 1 are connected through a guide surface 14. The guide surface 14 is higher than the first protruding block 12*a* and the second protruding block 12*b*, and is located behind the first protruding block 12*a* and the second protruding block 12*b* to guide a corresponding conductive terminal 2 to be assembled into each accommodating hole 11.

As shown in FIG. 1 and FIG. 2, the body 1 further has multiple through holes 15 running vertically therethrough. The accommodating holes 11 and the through holes 15 are respectively provided in multiple rows. The rows of accommodating holes 11 and the rows of through holes 15 are provided in a left-right direction at intervals. That is, only one row of the through holes 15 is arranged between two adjacent rows of the accommodating holes 11. Each row of the accommodating holes 11 and each row of the through holes 15 are respectively arranged in the front-rear direction, and the two adjacent rows of accommodating holes 11 are staggered in the front-rear direction. That is, two adjacent through holes 15 located between the two rows of accommodating holes 11 are corresponding to one accommodating hole 11 in one of the two rows of accommodating holes 11 in the left-right direction.

As shown in FIG. 1 and FIG. 2, each of the accommodating holes 11 corresponds to at least two of the through holes 15. In the present embodiment, some of the accommodating holes 11 correspond to four of the through holes 15, and each of their left and right sides is corresponding to two of the through holes 15. In the left-right direction, the first protruding block 12*a* and the second protruding block 12*b* are located between two through holes 15 directly opposite to each other. That is, the two through holes 15 are located outside the first protruding block 12*a* and the second protruding block 12*b*. In the front-rear direction, a length of each through hole 15 is greater than a length of the first protruding block 12*a* and a length of the second protruding block 12*b* to increase the elasticity of the body 1 near the first protruding block 12*a* and the second protruding block 12*b*.

Figure 3:
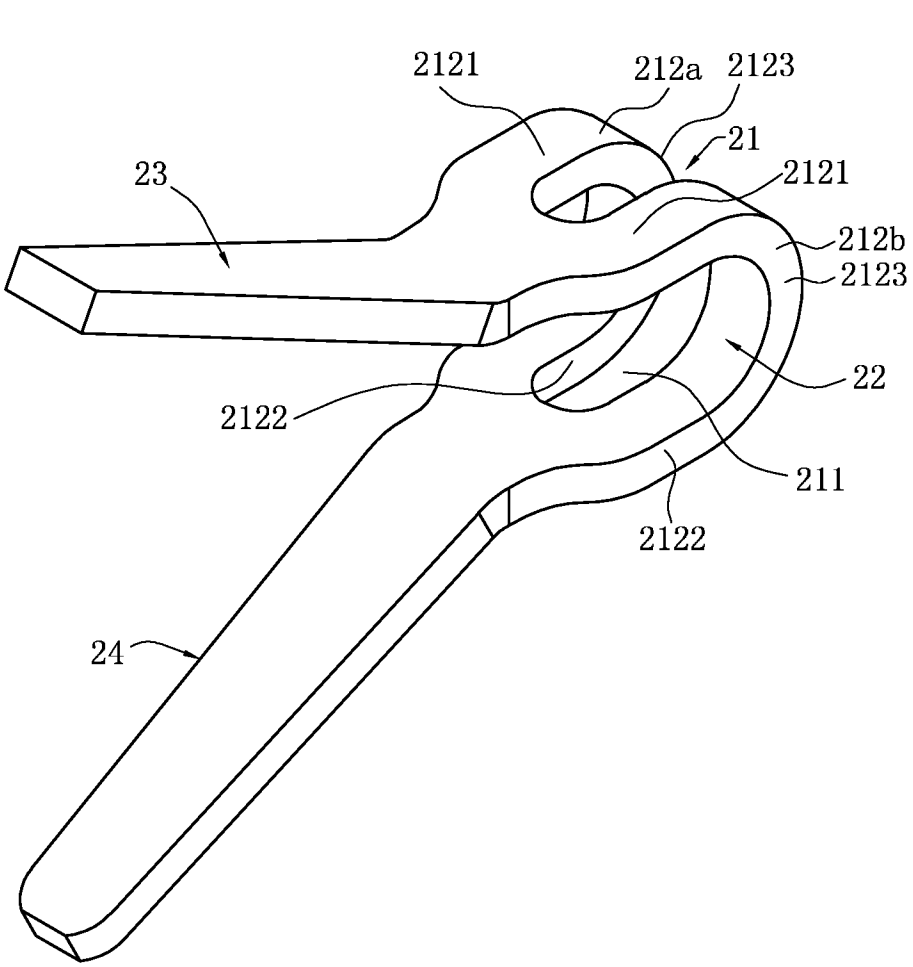
FIG. 3 is a perspective view of a conductive terminal in FIG. 1.
Figure 4:
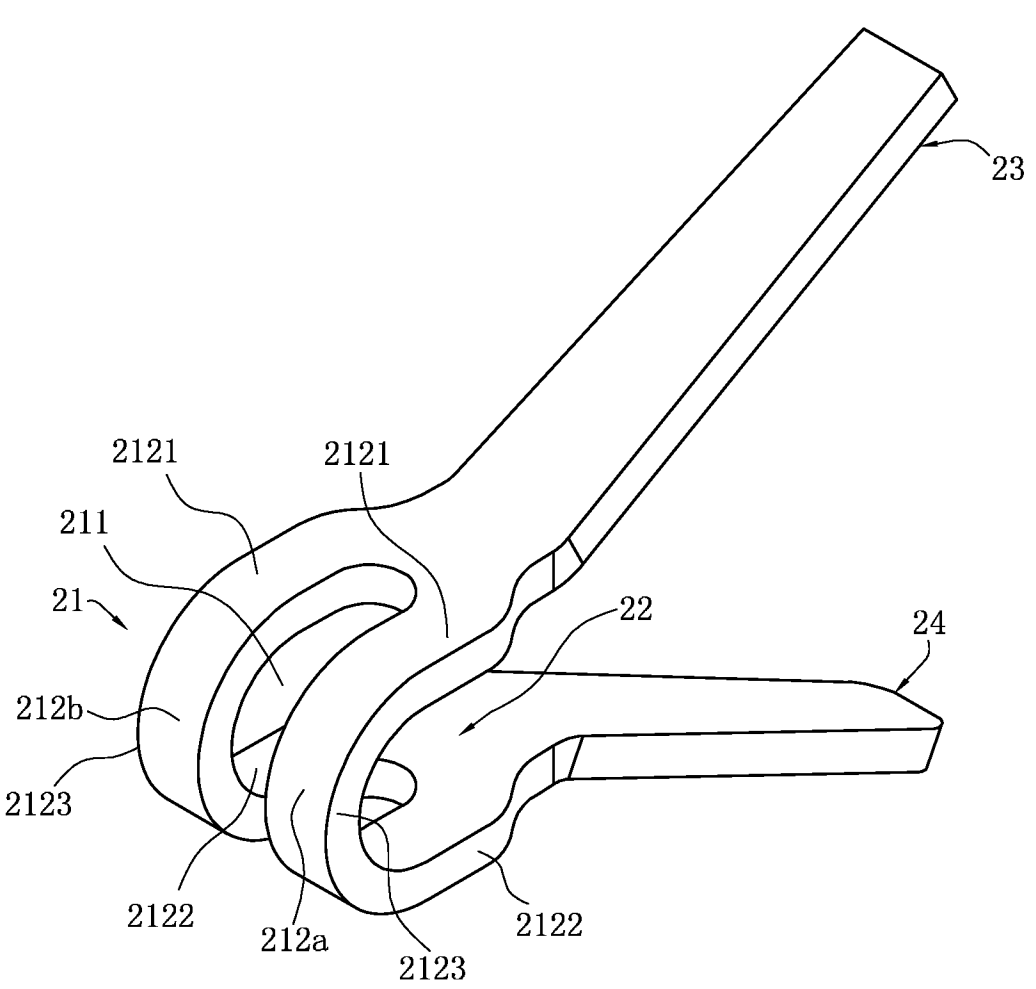
FIG. 4 is a perspective view of FIG. 3 being rotated 180 degrees horizontally.

As shown in FIG. 3 and FIG. 6, the conductive terminals 2 are formed by stamping a metal sheet. Each conductive terminal 2 is accommodated in the corresponding accommodating hole 11, and is limited between the platform 13 and the first protruding block 12*a*, and between the platform 13 and the second protruding block 12*b*.

As shown in FIG. 1 and FIG. 3, the conductive terminal 2 has a base 21, which is bending. The base 21 bends to form an accommodating space 22 opening forward. An upper elastic arm 23 extends upward from one end of the base 21 to be electrically connected with the first mating component 200. A lower elastic arm 24 extends downward from the other end of the base 21 to be electrically connected with the second mating component 300.

As shown in FIG. 3, FIG. 5 and FIG. 6, the base 21 has a through slot 211, and a first branch 212*a* and a second branch 212*b* located at left and right sides of the through slot 211. The through slot 211 extends forward along the base 21 to pass beyond the first protruding block 12*a* and the second protruding block 12*b*. However, a width of the through slot 211 is less than a distance between the first protruding block 12*a* and the second protruding block 12*b*.

As shown in FIG. 3, FIG. 5 and FIG. 6, each of the first branch 212*a* and the second branch 212*b* has an upper section 2121 located above the accommodating space 22, a lower section 2122 located below the accommodating space 22, and a connecting section 2123 located behind the accommodating space 22. The lower section 2122 of the first branch 212*a* is limited between the first protruding block 12*a* and the platform 13, and the lower section 2122 of the second branch 212*b* is limited to be between the second protruding block 12*b* and the platform 13. That is, the first protruding block 12*a* and the second protruding block 12*b* enter the accommodating space 22 to be located between the upper section 2121 and the lower section 2122. The connecting section 2123 is arc-shaped due to the bending of the base 21. The connecting section 2123 of the first branch 212*a* matches with an arc-shaped rear edge of the first protruding block 12*a*, and the connecting section 2123 of the second branch 212*b* matches with an arc-shaped rear edge of the second protruding block 12*b*, thus jointly limiting the conductive terminal 2 from moving forward.

As shown in FIG. 5 and FIG. 6, in the present embodiment, each conductive terminal 2 is assembled into the corresponding accommodating hole 11 downward from top thereof by a strip 400 connected to the upper elastic arm 23, until the lower section 2122 of the first branch 212*a* is located between the first protruding block 12*a* and the platform 13 and the lower section 2122 of the second branch 212*b* is located between the second protruding block 12*b* and the platform 13. In this process, the accommodating space 22 is maintained opening forward. Since a width of the base 21 is greater than the distance between the first protruding block 12*a* and the second protruding block 12*b* in the left-right direction, the lower section 2122 of the first branch 212*a* is abutted by the first protruding block 12*a* when passing downward across the first protruding block 12*a*, and the lower section 2122 of the second branch 212*b* is abutted by the second protruding block 12*b* when passing downward across the second protruding block 12*b*, such that the first branch 212*a* and the second branch 212*b* deform toward the through slot 211. When the lower sections 2122 completely pass through the first protruding block 12*a* and the second protruding block 12*b*, the base 21 returns to its original state, the lower section 2122 of the first branch 212*a* is limited between the first protruding block 12*a* and the platform 13, and the lower section 2122 of the second branch 212*b* is limited between the second protruding block 12*b* and the platform 13. To increase a contact area between the base 21 and the body 1, in the left-right direction, a width of the lower section 2122 of the first branch 212*a* is greater than a protruding length of the first protruding block 12*a*, and a width of the lower section 2122 of the second branch 212*b* is greater than a protruding length of the second protruding block 12*b*. Such configuration increases the contact area between the conductive terminal 2 and the body 1 to strengthen a position limiting effect of the conductive terminal 2, and may disperse a contact stress between the conductive terminal 2 and the body 1 to a certain extent.

Figure 7:
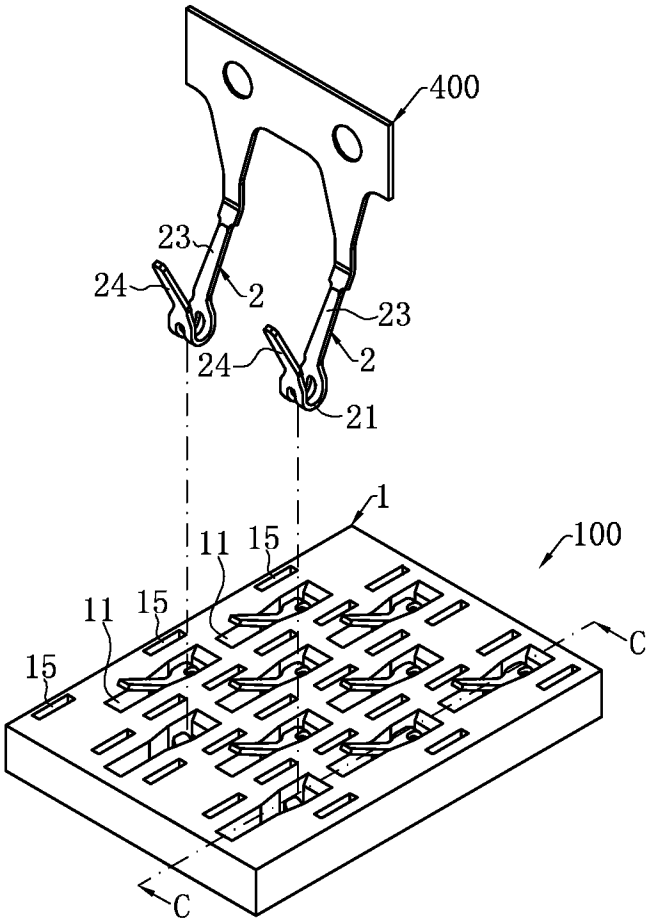
FIG. 7 is a schematic view of an electrical connector according to a second embodiment of the present invention and an assembly method thereof.
Figure 8:
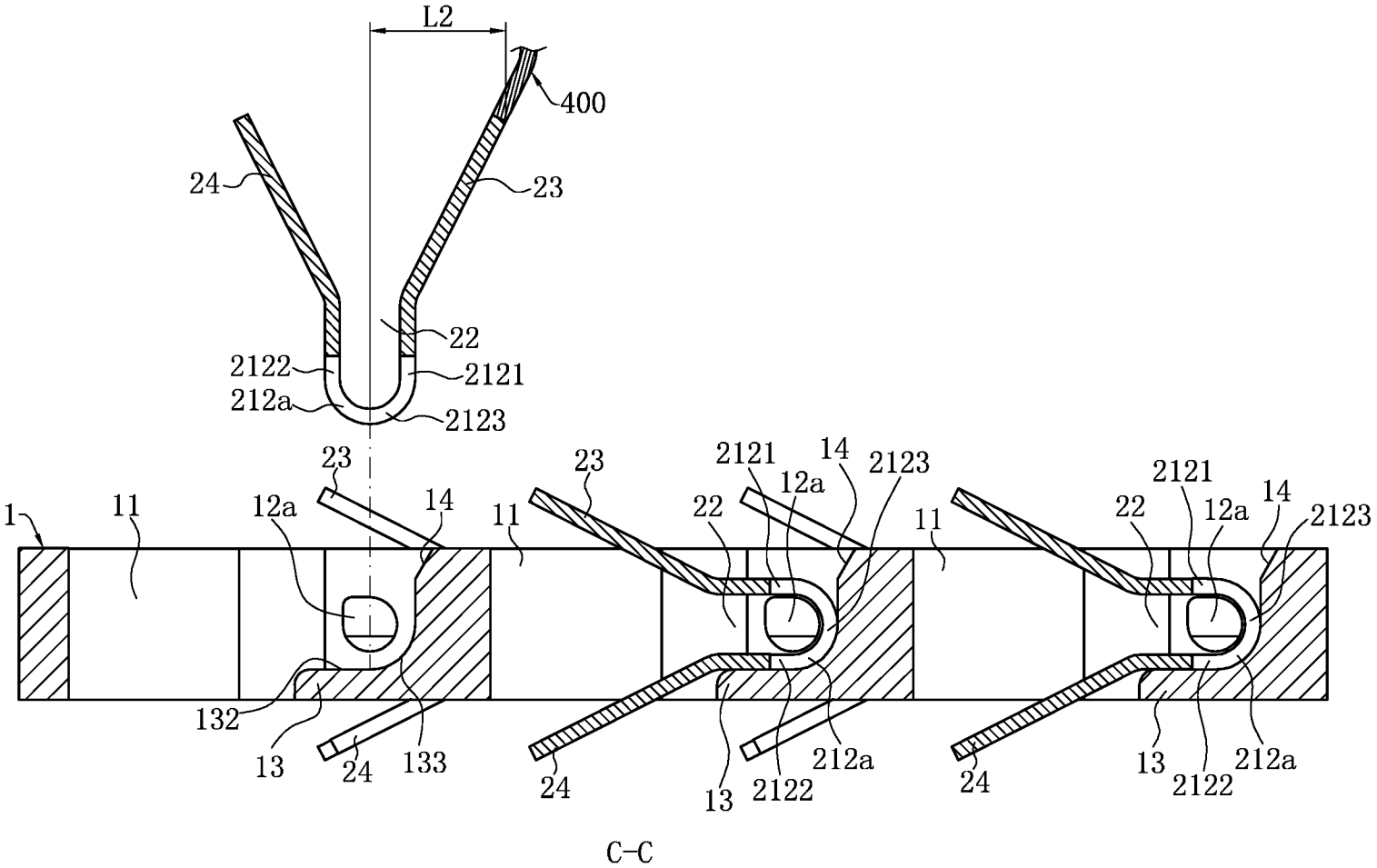
FIG. 8 is a sectional view of FIG. 7 along a line C-C.

FIG. 7 and FIG. 8 show an electrical connector 100 according to a second embodiment of the present invention, which is structurally different from the first embodiment only in that a lower edge of a first protruding block 12*a* and a lower edge of a second protruding block 12*b* (not shown) are arc-shaped so as to match with the connecting section 2123, which is also arc-shaped, in an assembly process of the conductive terminal 2. Other structures in the second embodiment are identical to those in the first embodiment, and are thus not further elaborated herein.

A method of manufacturing the electrical connector 100 according to the second embodiment includes the following steps.

S1: as shown in FIG. 7 and FIG. 8, the body 1 is provided, where the lower edge of the first protruding block 12*a* and the lower edge of the second protruding block 12*b* (not shown) are arc-shaped.

S2: as shown in FIG. 7 and FIG. 8, multiple conductive terminals 2 are provided, where the upper elastic arm 23 of each of the conductive terminals 2 is connected to the strip 400.

Figure 9:
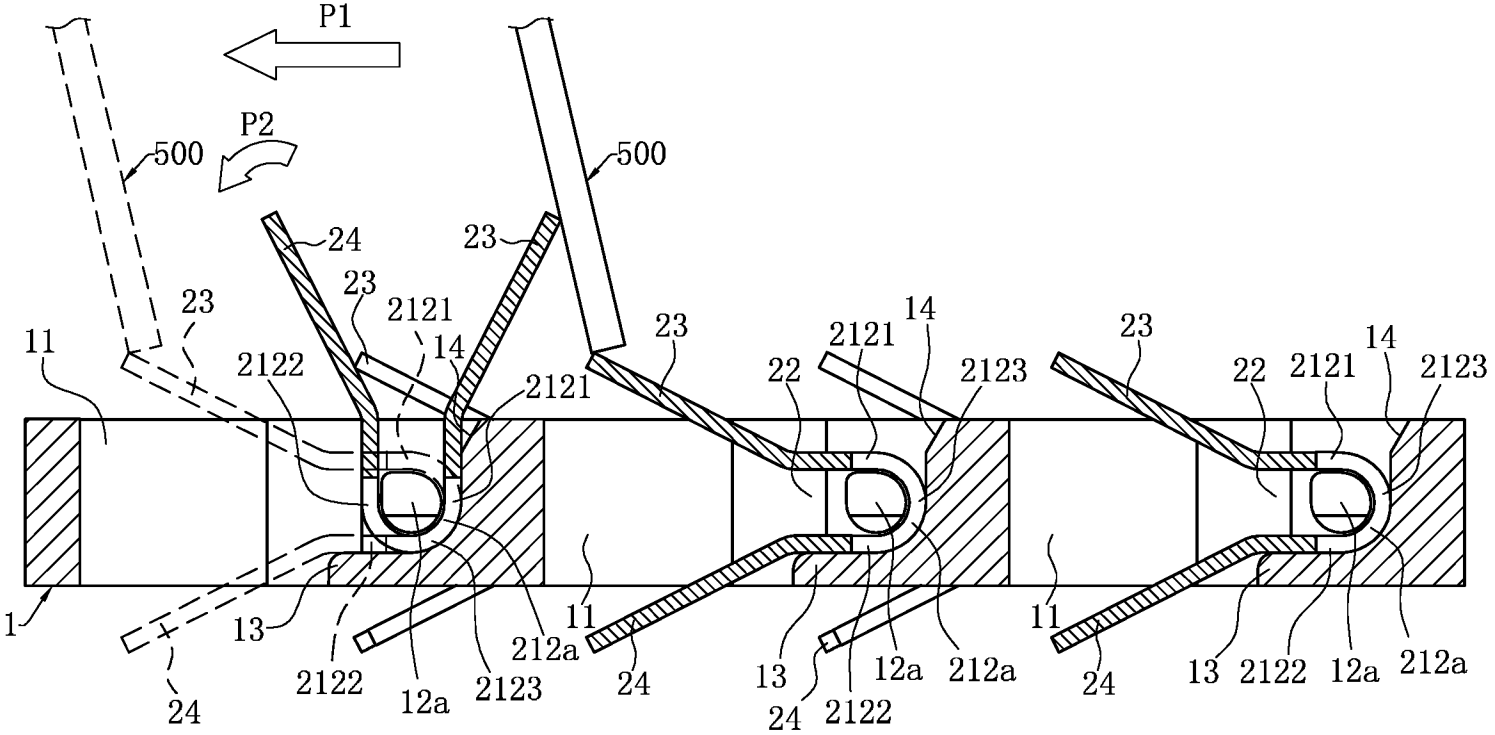
FIG. 9 is a schematic view of a conductive terminal in FIG. 8 being rotated in an accommodating hole of a body by a jig.

S3: as shown in FIG. 8 and FIG. 9, each conductive terminal 2 with the accommodating space 22 opening upward is inserted into the corresponding accommodating hole 11 by the strip 400. The connecting section 2123 of the first branch 212*a* passes downward across the first protruding block 12*a* and is abutted by the first protruding block 12*a*, and the connecting section 2123 of the second branch 212*b* passes downward across the second protruding block 12*b* and is abutted by the second protruding block 12*b*, such that the first branch 212*a* and the second branch 212*b* deform toward the through slot 211. After the connecting sections 2123 completely pass through the first protruding block 12*a* and the second protruding block 12*b*, the base 21 returns to its original state, such that the connecting section 2123 of the first branch 212*a* is located between the platform 13 and the first protruding block 12*a*, the connecting section 2123 of the second branch 212*b* is located between the platform 13 and the second protruding block 12*b*. Then the strip 400 is removed from the conductive terminals 2.

S4: as shown in FIG. 8 and FIG. 9, a jig 500 moves horizontally above the body 1 along an arrow P1 to drive each conductive terminal 2 to rotate counterclockwise (that is, along an arrow P2) by 90 degrees with the first protruding block 12*a* and the second protruding block 12*b* as axes, until the accommodating space 22 is open forward, the lower section 2122 of the first branch 212*a* is located between the platform 13 and the first protruding block 12*a*, and the lower section 2122 of the second branch 212*b* is located between the platform 13 and the second protruding block 12*b*. In the rotating process, the arc-shaped connecting sections 2123 match with the arc-shaped lower edge of the first protruding block 12*a* and the arc-shaped lower edge of the second protruding block 12*b*, and match with the arc surface 133 between the upper surface 132 of the platform 13 and the walls of the accommodating hole 11 in the front-rear direction, such that each conductive terminal 2 can be smoothly rotated. In the present embodiment, the jig 500 has a flat plate shape, and drives each conductive terminal 2 to rotate by abutting a tail end of the upper elastic arm 23.

The electrical connector 100 of the first embodiment may also be assembled with the conductive terminals 2 by adopting a method similar to the above method of the second embodiment. Specifically, each conductive terminal 2 with the accommodating space 22 opening upward is inserted into the corresponding accommodating hole 11, such that the connecting section 2123 of the first branch 212*a* is located between the platform 13 and the first protruding block 12*a*, and the connecting section 2123 of the second branch 212*b* is located between the platform 13 and the second protruding block 12*b*. Then, each conductive terminal 2 is driven to rotate counterclockwise by 90 degrees, such that the accommodating space 22 is open forward, the lower section 2122 of the first branch 212*a* is located between the platform 13 and the first protruding block 12*a*, and the lower section 2122 of the second branch 212*b* is located between the platform 13 and the second protruding block 12*b*.

As shown in FIG. 5 and FIG. 8, in the two embodiments, each of the conductive terminals 2 are assembled to the body 1 by the strip 400, and the strip 400 is connected to the tail end of the upper elastic arm 23. Ideally, to ensure each conductive terminal 2 to be smoothly inserted into the corresponding accommodating hole 11, the conductive terminals 2 and the strip 400 should be maintained relatively fixed in this process. However, in the present invention, each conductive terminal 2 will inevitably touch the first protruding block 12*a* and the second protruding block 12*b* of the corresponding accommodating hole 11, and reactive force of the first protruding block 12*a* and the second protruding block 12*b* to the conductive terminal 2 may cause the conductive terminal 2 to rotate relative to the strip 400 with the tail end of the upper elastic arm 23 as a rotating axis. Apparently, a moment arm L1 between the first protruding block 12*a* and the tail end of the upper elastic arm 23 in the first embodiment is greater than a moment arm L2 between the first protruding block 12*a* and the tail end of the upper elastic arm 23 in the second embodiment. Since a magnitude of a rotating torque is directly proportional to a length of the moment arm, the rotating torque of the conductive terminal 2 with the accommodating space 22 maintained opening forward in the first embodiment is greater than the rotating torque of the conductive terminal 2 with the accommodating space 22 maintained opening upward in the second embodiment. Therefore, in comparison with the manufacturing method of the first embodiment, in the manufacturing method of the second embodiment, the conductive terminals 2 are less prone to rotation, which makes assembly easier and smoother.

To sum up, the electrical connector and the method for manufacturing the same according to certain embodiments of the present invention has the following beneficial effects:

1) The lower section 2122 of the first branch 212*a* is limited between the first protruding block 12*a* and the platform 13, such that the conductive terminal 2 is limited in the accommodating hole 11 in a vertical direction. The connecting sections 2123 of the first branch 212*a* and the second branch 212*b* are limited between the first protruding block 12*a* and the walls of the accommodating hole 11, such that the conductive terminal 2 is limited to the accommodating hole 11 in the front-rear direction. The conductive terminal 2 does not interfere with the body 1 much, and therefore the conductive terminal 2 does not directly apply a relatively large stress to the body 1, and the body 1 does not easily deform due to the stress. The lower section 2122 of the second branch 212*b* is limited between the second protruding block 12*b* and the platform 13, such that the first branch 212*a* and the second branch 212*b* on both sides of the through slot 211 are both limited. Thus, the conductive terminal 2 does not warp upward unilaterally after assembly, and a positioning effect with the insulating body 1 is better.

2) The body 1 further has the multiple through holes 15 running vertically therethrough and distributed between the accommodating holes 11. Each of the accommodating holes 11 corresponds to two of the through holes 15. In the left-right direction, the first protruding block 12*a* and the second protruding block 12*b* are located between the two through holes 15. That is, the two through holes 15 are located outside the first protruding block 12*a* and the second protruding block 12*b*. In the front-rear direction, the length of the through hole 15 is greater than the length of the first protruding block 12*a* and the length of the second protruding block 12*b* to increase the elasticity of the body 1 near the first protruding block 12*a* and the second protruding block 12*b*, and to further allow the conductive terminal 2 to pass through the first protruding block 12*a* and the second protruding block 12*b* in the assembly process.

3) The accommodating space 22 is maintained opening upward in the process of assembling the conductive terminal 2 to the body 1, which helps to reduce the rotating torque of the conductive terminal 2 in the assembly process, and prevent the conductive terminal 2 from rotating relative to the strip 400 in the assembly process and thus affecting installation.

4) To increase a contact area between the base 21 and the body 1, in the left-right direction, a width of the lower section 2122 of the first branch 212*a* is greater than a protruding length of the first protruding block 12*a*, and a width of the lower section 2122 of the second branch 212*b* is greater than a protruding length of the second protruding block 12*b*. Such configuration increases the contact area between the conductive terminal 2 and the body 1 to strengthen a position limiting effect of the conductive terminal 2, and may disperse a contact stress between the conductive terminal 2 and the body 1 to a certain extent.

5) In the rotating process, the arc-shaped connecting sections 2123 match with the arc-shaped lower edge of the first protruding block 12*a* and the arc-shaped lower edge of the second protruding block 12*b*, and match with the arc surface 133 between the upper surface 132 of the platform 13 and the walls of the accommodating hole 11 in the front-rear direction, such that each conductive terminal 2 can be smoothly rotated.

6) The connecting section 2123 is arc-shaped due to the bending of the base 21. The connecting section 2123 of the first branch 212*a* matches with an arc-shaped rear edge of the first protruding block 12*a*, and the connecting section 2123 of the second branch 212*b* matches with an arc-shaped rear edge of the second protruding block 12*b*, thus jointly limiting the conductive terminal 2 from moving forward.

7) The wall of each accommodating hole 11 behind the base 21 and an upper surface of the body 1 are connected through a guide surface 14. The guide surface 14 is higher than the first protruding block 12*a* and the second protruding block 12*b*, and is located behind the first protruding block 12*a* and the second protruding block 12*b* to guide a corresponding conductive terminal 2 to be assembled into each accommodating hole 11.

8) Each of the first protruding block 12*a* and the second protruding block 12*b* has a guide chamfer 121. The guide chamfers 121 of both the first protruding block 12*a* and the second protruding block 12*b* are provided to be close to each other downward from top thereof to guide the base 21 to pass through the first protruding block 12*a* and the second protruding block 12*b*.

9) The rear edges of the first protruding block 12*a* and the second protruding block 12*b* are arc-shaped, so as to match with the connecting sections 2123 to limit the conductive terminal 2 from moving forward.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be electrically connected with a first mating component and a second mating component, the electrical connector comprising:

a body, having an accommodating hole running vertically therethrough, wherein the body is provided with a first protruding block and a platform protruding into the accommodating hole, and the platform is located below the first protruding block; and a conductive terminal, accommodated in the accommodating hole, wherein the conductive terminal has a base which is bending, the base bends to form an accommodating space opening forward to accommodate the first protruding block, an upper elastic arm extends upward from one end of the base to be electrically connected with the first mating component, and a lower elastic arm extends downward from the other end of the base to be electrically connected with the second mating component, wherein the base has a through slot, and a first branch and a second branch located at a left side and a right side of the through slot, each of the first branch and the second branch has an upper section located above the accommodating space, a lower section located below the accommodating space, and a connecting section located behind the accommodating space, and the lower section of the first branch is limited between the first protruding block and the platform.

2. The electrical connector according to claim 1, wherein the connecting section is arc-shaped, and a rear edge of the first protruding block is arc-shaped to match with the connecting section and to limit the conductive terminal from moving forward.

3. The electrical connector according to claim 1, wherein the body is further provided with a second protruding block opposite to the first protruding block in a left-right direction in the accommodating hole, the second protruding block is accommodated in the accommodating space and is located above the platform, the lower section of the second branch is limited between the second protruding block and the platform, each of the first protruding block and the second protruding block has a guide chamfer, and the guide chamfers of both the first protruding block and the second protruding block are provided close to each other downward from top thereof.

4. The electrical connector according to claim 1, wherein in a left-right direction, a width of the lower section of the first branch is greater than a protruding length of the first protruding block.

5. The electrical connector according to claim 1, wherein the through slot extends forward along the base and passes beyond the first protruding block.

6. The electrical connector according to claim 1, wherein a wall of the accommodating hole behind the base and an upper surface of the body are connected through a guide surface, and the guide surface is higher than the first protruding block.

7. The electrical connector according to claim 1, wherein the connecting section is arc-shaped, and in a front-rear direction, an upper surface of the platform and walls of the accommodating hole are connected through an arc surface to match with the connecting section.

8. The electrical connector according to claim 7, wherein a lower edge of the first protruding block is arc-shaped to match with the connecting section in an assembly process of the conductive terminal.

9. The electrical connector according to claim 1, wherein the platform extends forward and passes beyond the first protruding block.

10. The electrical connector according to claim 9, wherein the platform is connected to walls at a left side and a right side of the accommodating hole.

11. The electrical connector according to claim 10, wherein the platform has a channel correspondingly located below the first protruding block, and the channel runs downward through the body.

12. The electrical connector according to claim 1, wherein the body further has a through hole running vertically therethrough, and in a left-right direction, the through hole is located at a side of the first protruding block away from the corresponding conductive terminal to increase elasticity of the body near the first protruding block.

13. The electrical connector according to claim 12, wherein in a front-rear direction, a length of the first protruding block is less than a length of the through hole.

14. The electrical connector according to claim 12, comprising a plurality of conductive terminals, wherein the body has a plurality of accommodating holes and a plurality of through holes, each of the accommodating holes correspondingly accommodates one of the conductive terminals, the accommodating holes and the through holes are respectively provided in a plurality of rows, the rows of the accommodating holes and the rows of the through holes are provided in the left-right direction at intervals, each row of the accommodating holes and each row of the through holes are respectively arranged in a front-rear direction, and two adjacent ones of the through holes located between two rows of the accommodating holes are corresponding to one accommodating hole in one of the two rows of the accommodating holes in the left-right direction.

15. A method for manufacturing an electrical connector, comprising:

S1: providing a body, wherein the body has an accommodating hole running vertically therethrough, the body is provided with a first protruding block and a platform protruding into the accommodating hole, the platform is located below the first protruding block;

S2: providing a conductive terminal connected to a strip, the conductive terminal has a base which is bending, the base bends to form an accommodating space, an upper elastic arm extends upward from one end of the base, a lower elastic arm extends downward from the other end of the base, the base has a through slot, and a first branch and a second branch located at a left side and a right side of the through slot, and each of the first branch and the second branch has an upper section located above the accommodating space, a lower section located below the accommodating space, and a connecting section located behind the accommodating space;

S3: inserting the conductive terminal with the accommodating space opening upward into the accommodating hole by the strip, such that the connecting section of the first branch passes across the first protruding block and to be located between the platform and the first protruding block; and S4: rotating the conductive terminal counterclockwise with the first protruding block as an axis, until the accommodating space is open forward, and the lower section of the first branch is located between the platform and the first protruding block.

16. The method according to claim 15, wherein in the step S4, the conductive terminal is rotated counterclockwise by 90 degrees.

17. The method according to claim 15, wherein in the step S1, the body is further provided with a second protruding block opposite to the first protruding block in a left-right direction in the accommodating hole, and the second protruding block is located above the platform; in the step S3, the connecting section of the first branch is abutted by the first protruding block when passing downward across the first protruding block, and the connecting section of the second branch is abutted by the second protruding block when passing downward across the second protruding block, such that the first branch and the second branch deform toward the through slot; and in the step S4, after the conductive terminal is rotated counterclockwise, the lower section of the second branch is limited between the second protruding block and the platform.

18. The method according to claim 15, wherein in the step S1, the strip is connected to a tail end of the upper elastic arm.

19. The method according to claim 15, wherein the strip is removed after the step S3 and before the step S4 is proceeded, and in the step S3, the conductive terminal is driven to rotate via a jig.

20. The method according to claim 15, wherein the connecting section is arc-shaped, a lower edge of the first protruding block is arc-shaped, and in a front-rear direction, an upper surface of the platform and walls of the accommodating hole are connected through an arc surface to match with the connecting section in the step S3.

* * * * *